United States Patent [19]

Corsette

[11] 3,945,062

[45] Mar. 23, 1976

[54] TOILET CHEMICAL DISPENSER

[76] Inventor: Douglas F. Corsette, 6559 Firebrand St., Los Angeles, Calif. 90045

[22] Filed: Jan. 24, 1975

[21] Appl. No.: 543,950

[52] U.S. Cl. ..... 4/227; 222/373; 222/440; 4/228

[51] Int. Cl.[2] ..... E03D 9/02

[58] Field of Search ..... 222/181, 373, 440; 4/227, 4/228

[56] References Cited

UNITED STATES PATENTS

| | | | |
|---|---|---|---|
| 1,728,737 | 9/1929 | Stoner | 4/227 |
| 2,839,763 | 6/1958 | Newsom | 4/227 |
| 3,769,640 | 11/1973 | Castronovo | 4/228 |
| 3,778,850 | 12/1973 | Bryan | 4/227 |

*Primary Examiner*—Allen N. Knowles
*Assistant Examiner*—Hadd Lane
*Attorney, Agent, or Firm*—Richard E. Babcock, Jr.

[57] ABSTRACT

A container of the chemical to be dispensed is supported in inverted position in the toilet flush tank with the mouth of the container opening downwardly. The dispensing closure is sealingly associated with and axially adjustable on the container around its mouth. The closure has an open lower end normally immersed in the water within the tank and separated by a partition from the metering chamber within the upper end of the closure communicating with the container mouth. The liquid is delivered by gravity into the metering chamber, to a depth to cover said mouth. Pressurized air delivered from the pump chamber into the upper portion of the metering chamber above the mouth exerts a pressure on the liquid within the metering chamber to force the same out through a discharge port and tube leading to the tank overflow pipe.

6 Claims, 4 Drawing Figures

TOILET CHEMICAL DISPENSER

This invention relates to improvements in a combined shipping closure and automatic dispenser for delivering substantially uniform charges of a liquid chemical preparation from a container housed within a toilet flush tank, directly into the toilet bowl, when the bowl is refilled with water following each flushing thereof.

It is an important object of the invention to delay the delivery of the chemical to the toilet bowl until the flushing of the latter has been completed and it has been or is being refilled with water, whereby substantially all of the chemical in relatively concentrated form may be retained in the toilet bowl for the full period of time between flushings of the toilet bowl. There is thus avoided the loss of unused chemical down the drain such as occurs in prior art dispensers in which the chemical is delivered into the flush tank so that only a small proportion of each charge, in substantially diluted condition is retained within the toilet bowl.

Further incidental objects are: to provide such a combined closure and automatic dispenser which is adjustable for optimum use with flush tanks of varying depths, but which is simple, compact in structure and provides for the adjustment of the size of individual charges of chemical, as well as providing compensation for varying altitudes at which the device is used. Additional objects are: to provide for deactivating and releasing the device so as to permit its removal, together with its associated chemical container from a flush tank without loss or spillage of the container contents, as for instance during repairs to the tank or its flushing mechansim; and to permit refilling and replacement of the chemical container.

SUMMARY OF THE INVENTION

The combined closure and automatic dispenser of the invention is adapted for application to a generally conventional liquid product container to be supported in the flush tank in inverted position. The closure and dispenser comprises an open ended sleeve having an upper end sealingly associated with and axially adjustable on the container, the lower end of the sleeve being adapted to extend substantially beneath the surface of the water in the tank when the latter is at its maximum level. A partition within the sleeve divides it into an enclosed metering chamber between the partition and the container and a downwardly opening pump chamber communicating through its lower end with the water in the tank. The metering chamber communicates with the pump chamber through a pressure equalizing passage which opens into the metering chamber at a first level above the container mouth, there being a discharge conduit opening from the metering chamber at a second level below the said first level. Sealing means supported by the sleeve within the metering chamber is movable axially with the sleeve into and from sealing engagement with respect to the container mouth to permit use of the device either as a sealed closure for the container or as an automatic dispenser for the container contents.

Preferably the aforesaid sleeve is threaded onto the container whereby to achieve its axial adjustment and has a suitable sealing means associated with its threads for preventing any substantial or material leakage of fluid between the interconnected container and sleeve.

To promote an understanding of the invention, reference will now be made to the preferred embodiment thereof, illustrated in the accompanying drawings, and specific language will be used to describe the same. It will nevertheless be appreciated that no limitation of the scope of the invention is thereby intended but that such modifications and alterations are contemplated as would normally occur to one skilled in the art to which the invention relates.

IN THE ACCOMPANYING DRAWINGS

Figure 1:
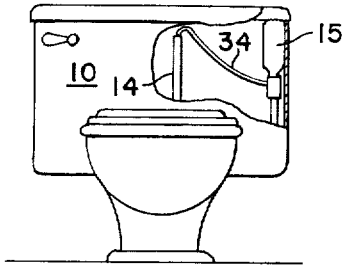
FIG. 1 is an elevational view of a flush toilet equipped with the dispenser of the invention, parts of the flush tank being broken away to permit a general view of the dispenser therein.

Referring now in detail to the accompanying drawings, the numeral 10 therein designates a conventional toilet flush tank (the top of which is not illustrated) within which, the operation of flushing and subsequently permitting automatic refill of the tank, causes the water contents thereof to rise and fall between a maximum level 12 (FIG. 3) and a minimum level 13 (FIG. 4) at 13 in FIG. 4.

A conventional overflow pipe 14 within the flush tank 10 has its open upper or intake end located at or just above the maximum liquid level within the tank and has its lower end communicating with the toilet bowl for delivering any overflow from the tank into that bowl in accordance with usual practice.

The water supply mechanism, valves and operating means for flushing and refilling the tank and the toilet bowl may be of any conventional construction, and since they constitute no part of the prevent invention are omitted from the drawings.

In carrying out the invention, a suitable cleaning deodorizing and/or germicidal liquid composition is metered in predetermined amounts directly into the upper end of the standpipe, and thus into the toilet bowl, in response to rise and fall of liquid within the tank. For this purpose there is provided an automatic dispenser which includes a liquid product container 15. In accordance with usual practice, the container 15 is exemplified by the conventional plastic bottle which may have somewhat flexible walls. For supporting the container in an inverted position within the flush tank, as is customary in devices of the type here disclosed, the lower end of the bottle is formed with a dove tailed or under cut groove 16 within which is disposed a hook in the form of a slide 17 adapted to be manually projected laterally outwardly to overlie the upper edge of the toilet tank and to support the bottle therefrom at the desired level, the hook preferably having a depending leg 18 for abutment against the outer side wall of the tank to prevent inward displacement of the hook and bottle.

At its downwardly directed lower end, the inverted bottle or container 15 is provided with a generally conventional cylindrical neck 20 which may include a logically reduced diameter discharge spout, the lower end of which is open to define the mouth 22 of the container.

The dispensing closure 23 in the form of a generally cylindrical sleeve open at both ends, has its upper end sealingly associated with and axially adjustable in suitable manner on the container neck, while the open lower end of the sleeve normally projects beneath the maximum level 12 of the water within the flush tank.

A partition 27 within the sleeve medially between its ends divides the interior of the sleeve into an enclosed metering chamber 28, extending between the partition and the downwardly directed container shoulder 29 at the juncture of the spout with the container neck, and a downwardly opening pump chamber 30 which as above indicated communicates through its lower end with the liquid in the tank.

The metering chamber 28 communicates with the pump chamber 30 through a pressure equalizing passage defined by a small standpipe 31 extending from the upper part of the pump chamber through the partition 27 and thence through a port 32 opening into the upper portion of the metering chamber at a level which will normally be substantially above that of the container mouth 22 in all operative positions.

A hollow nipple 33, opening from the sleeve 23, defines a liquid discharge port at the intake end of a discharge conduit, here exemplified by a flexible tube 34, the tube being coupled to the nipple and having its outlet end discharging into the upper end of the overflow pipe 14 at a level appreciably higher than the metering chamber 28.

Carried by the sleeve 23, within the metering chamber 28, is a flow control cup which in the preferred embodiment is defined by an annular wall 35 on the partition 27 within and concentrically to the sleeve 23, the annular wall 35 being preferably integral with the partition 27 which thus functions as the end wall of the cup.

In order that the sleeve 23 may be selectively axially adjusted to function either as a closure and shipping seal for the container, or as an automatic liquid metering and dispensing device, the upper end of the sleeve is internally threaded at 36 for suitable cooperation with external threads 37 around the container neck, whereby rotation of the sleeve on the container neck may selectively serve to activate or to deactivate sealing means carried by the sleeve and by the container respectively.

Such sealing means are exemplified by an annular groove 38 in the partition 27 for snug sealing reception of the mouth of the container and preferably also an annular sealing bead 40 encircling the spout 21 adjacent its base for sealing engagement with the annular wall of the flow control cup 35.

It is important also that the interconnection between the sleeve 23 and the container 10 be reasonably fluid tight so as to prevent leakage of air pressure from the metering chamber at a rate sufficient to render the device wholly or partially inoperative. To this end the threaded interconnection 36, 37 between the sleeve and the container neck are of such close fit as to achieve the desired degree of fluid tightness and if desired, there may be added to the sleeve a somewhat resilient sealing bead 42 encircling the container neck and snugly engaging the cylindrical portion of the neck.

The device of the present invention may be adapted for efficient use with flush tanks of varying depths, so as to utilize substantially the full range of rise and fall of water within the tank for actuating the dispensing operation. The sleeve in the preferred embodiment is provided with an extension sleeve section 44 which is slidably and telescopically received within the pump chamber and may be adjusted downwardly therefrom to any desired extent. It will be apparent that with or without the addition of such an extension 44, the pump chamber provides an excellent and convenient storage space within which the flexible tube or conduit 34 may be coiled and stored during shipping (as indicated in broken lines in FIG. 2) in readiness for connection to the discharge nipple 33 and to establish communication between that nipple and the end of the flush tank overflow pipe in the manner hereinbefore described.

Figure 2:
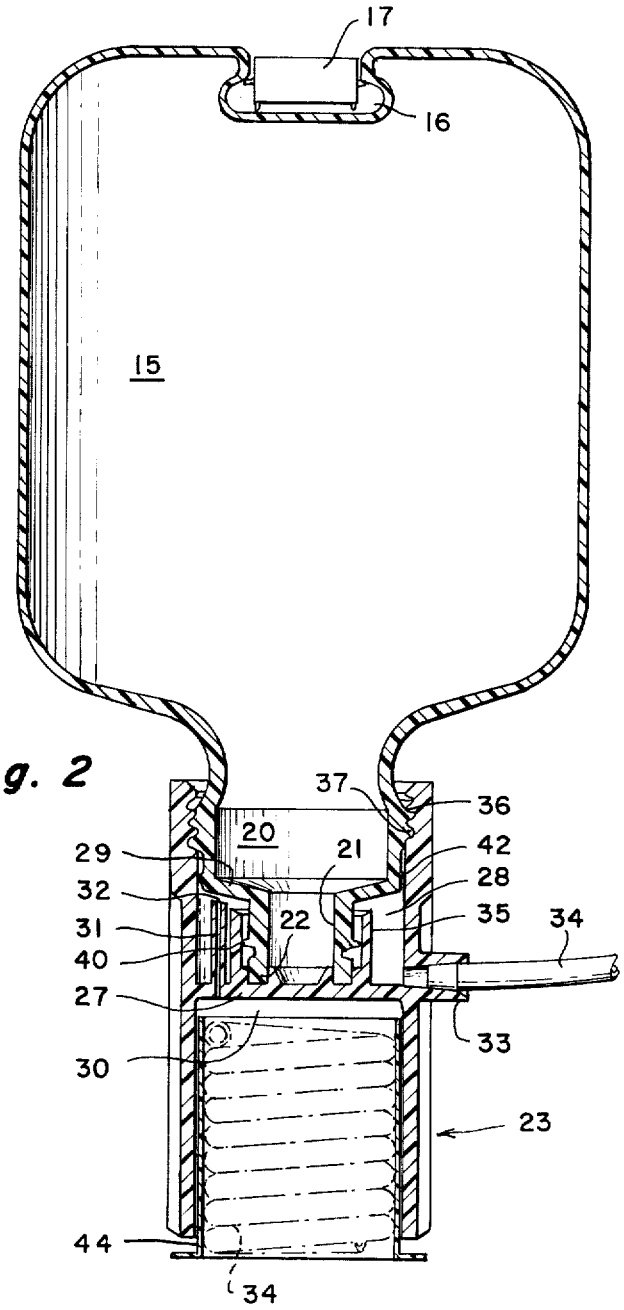
FIG. 2 is an enlarged cross-section of the dispenser per se.

In the use of the invention, it will be readily appreciated that the container, when received by the purchaser will normally have been filled with a supply of cleaning deodorizing and/or germicidal liquid at a bottling plant and will have been shipped with the dispensing sleeve applied in sealing relation to the container, as shown in FIG. 2. In order to place the dispenser in use, the flexible tube 34 is removed from the telescopic extension section 44 of the sleeve and one end thereof is coupled to the nipple 33 while its discharge end is inserted into the upper end of the flush tank overflow pipe 14, the cover of the flush tank having been removed for the purpose of installing the invention.

The container will then be inverted and its hook 18 activated for supporting the inverted container from the upper edge of the tank, following which, the dispensing closure 23 will be loosened by rotation to open the seals 38 and 40, (as in FIG. 3) so that by the ensuing action of gravity, as well as by partial collapse of the flexible container wall if the container is of the flexible wall type, liquid will then be discharged into the cup 35 and a portion of liquid normally will overflow into the metering chamber 28 to prime the latter.

Figure 3:
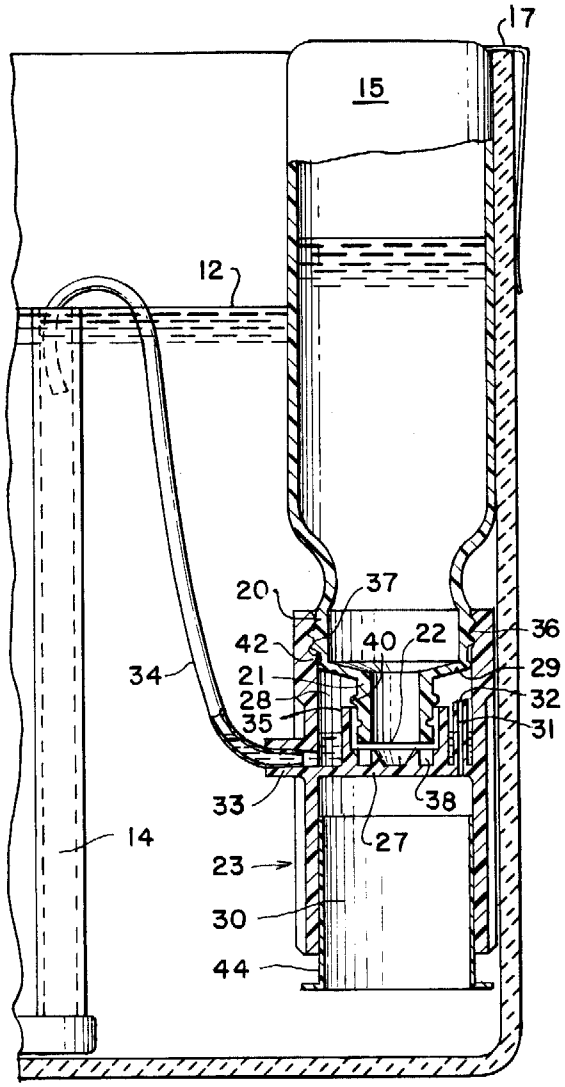
FIGS. 3 and 4 are generally similar sectional views of the dispenser and its associated flush tank respectively illustrating different phases of operation of the dispenser responsive to changes in water level within the flush tank.

As the container is then lowered into the tank for support by its hook 18, as in FIG. 3, the lower end of the pump chamber 30 is inserted downwardly into the water within the tank. The resulting rising water level within the pump chamber 30 will progressively compress the air within the pump chamber, forcing a portion of that air upwardly through the passage 31 into the metering chamber 28. Such rising air pressure within the metering chamber will force a portion of the liquid within the cup 35 back upwardly into the container 10. Since the discharge end of the conduit 34 will be at a location very materially above the upper edge of the flow control cup 35, the level of the chemical within the cup 35 will be progressively lowered to a level below the container mouth so as to admit compressed air into the container to replace the liquid theretofore discharged before the pressure increases sufficiently to eject liquid from the metering chamber 28 through the tube 34, and into the overflow pipe. The resultant drop in pressure within the metering chamber will result in a partial refilling of the metering chamber by liquid from the container to a level above the lower end of the discharge conduit 34. At this time, the various liquid levels will be substantially as shown in FIG. 3.

Figure 4:
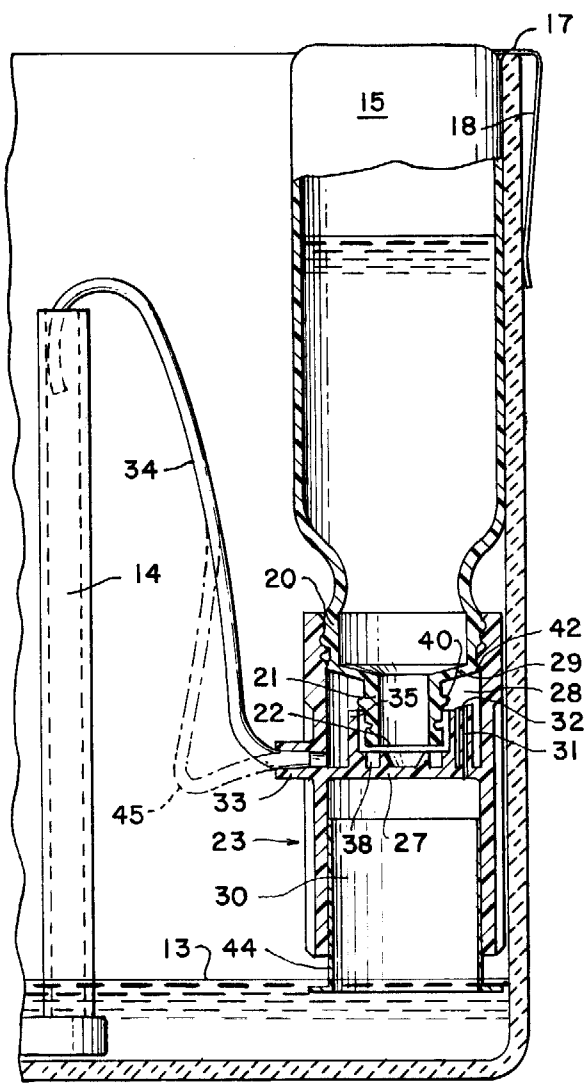

When the water level of the tank is lowered by flushing of the tank, as in FIG. 4, air may be drawn backwardly through the discharge conduit into the metering chamber 28 and thence through the equalizing passage, thus to permit the water level within the pump chamber to drop, together with that of the tank and thus to replenish the air supply within the pump chamber. It is not necessary to operation of the invention that the lower end of the sleeve 23 and its extension 44 ever be uncovered by the water within the tank so as to permit refilling with air, as is necessary in various prior art devices of the same general nature, although, if the lower end of the chamber is thus uncovered, it will have no adverse effect whatsoever on operation of the device.

After the tank is flushed to its minimum level of FIG. 4 as it thereafter refills, the resultant rising water level again compresses air within the pump chamber and such pressure is communicated to the metering chamber in the manner above described to thus expel another metered charge of liquid into the upper end of the overflow pipe and thus into the toilet bowl.

It is to be noted of course that due to the location of the upper end 32 of the equalizing passage above the highest level of liquid to be encountered within the metering chamber 28, and also because of the backflow of air through the discharge tube 34 and nipple 33 to the metering chamber 28, when the tank water level is lowered, there is no overflow or siphoning of liquid in the metering chamber through the pressure equalizing passage 31 back into the flush tank, no valves or moving parts whatsoever being necessary to achieve this most desirable result.

It is to be noted that a dispensing closure as above described serves both as a shipping closure for the container and as a dispenser for automatically dispensing the container contents in metered charges.

Furthermore it will be noted that the size of the charges of liquid product dispensed may readily be adjusted by rotating the dispenser sleeve 23 in the manner of a faucet valve to change the axial position of the flow control cup 35 on the discharge spout. The dispenser may obviously be selectively activated and deactivated while still in the tank and it may be readily removed for refilling of the container. By virtue of the telescopic extension of the sleeve, the device may be readily adapted for installation in optimum manner in tanks of varying depths, and downward adjustment of the extension 44 to increased depth below the water level in tank 15 will result in increased pressure within the metering chamber, with possibilities of increasing the volume of the charges of dispensed chemicals.

Also, if desired, the discharge tube 34 may be arranged, as indicated in broken lines in FIG. 4 to create a liquid trap 45 which in turn will produce a negative pressure in the metering chamber as the tank water recedes, thus drawing an increased charge of chemical into the metering chamber. The liquid in the trap will eventually be sucked back into the metering chamber to permit an influx of air thereinto through the conduit 34, so that the operation of the device may then proceed as above described.

Having thus described my invention, I claim:

1. A liquid product dispenser for use in a conventional flush tank and automatically operable by rise and fall of water within said tank between predetermined minimum and maximum levels, comprising in combination:

a liquid container having a generally cylindrical neck terminating in a discharge spout defining the mouth of said container;

means for supporting the container in inverted position in a flush tank;

a dispensing closure for said container comprising an open ended sleeve having an upper end sealingly associated with and axially adjustable on said container neck and a lower end adapted to extend into said water in the tank;

a partition within said sleeve between its ends dividing same into an enclosed metering chamber between said partition and said container and a downwardly opening pump chamber for communication through its lower end with the water in said tank;

a flow control cup carried by said sleeve within the metering chamber for axial movement with said sleeve into and from sealing engagement with said spout;

said metering chamber communicating with said pump chamber through a pressure equalizing passage which communicates with the metering chamber at a first level above said cup;

there being a discharge conduit communicating with said metering chamber at a second level below said first level and at a location outside of said cup.

2. The combination of claim 1 including interengaged threads on the said container neck and said sleeve respectively for axially adjusting said sleeve on the container neck responsive to relative rotary movement between said sleeve and said neck.

3. The combination of claim 1, including an extension sleeve sealingly telescopically associated with said first mentioned sleeve for adjustably extending said pump chamber downwardly.

4. The combination of claim 1 in which said container is defined by flexible walls so as to be partially collapsible responsive to variations in pressure within the container.

5. The combination of claim 1 in which said flow control cup has an upwardly directed annular skirt loosely encircling and extending to a level above the mouth of the container.

6. The combination of claim 5 in which product entrapped within said metering chamber is normally at a level between the openings to said chamber of the pressure equalizing passage and the discharge conduit and covers the latter, whereby air pressure transmitted to the metering chamber through said equalizing passage is imposed on the surface of said entrapped liquid to expel said liquid through the discharge conduit.

* * * * *